United States Patent [19]

Lipperts

[11] 4,109,123

[45] Aug. 22, 1978

[54] VACUUM SWITCH

[75] Inventor: Joseph H. F. G. Lipperts, Hengelo, Netherlands

[73] Assignee: Hazemeijer B.V., Hengelo, Netherlands

[21] Appl. No.: 764,238

[22] Filed: Jan. 31, 1977

[51] Int. Cl.[2] ..... H01H 33/66

[52] U.S. Cl. ..... 200/144 B; 200/147 R

[58] Field of Search ..... 200/144 B, 147 R

[56] References Cited

U.S. PATENT DOCUMENTS

| | | | |
|---|---|---|---|
| 3,471,666 | 10/1969 | Barkan | 200/147 R |
| 3,818,164 | 6/1974 | Mizutani et al. | 200/144 B |

*Primary Examiner*—Robert S. Macon

*Attorney, Agent, or Firm*—Watson, Cole, Grindle & Watson

[57] ABSTRACT

A vacuum switch which includes a stationary contact element and a movable contact element, at least one of the elements comprising a disc-shaped contact portion and a bush-shaped portion, and a conductor positioned within the bush-shaped portion and electrically connected in series with the associated contact element; the conductor being in spiral form and the spaces between the turns of the spirals, between the conductor and the bush-shaped portion and between the conductor and the disc-shaped contact portion being partially or completely filled with a solid insulating material.

6 Claims, 3 Drawing Figures

VACUUM SWITCH

BACKGROUND OF THE INVENTION

1. Field of the Invention

This invention relates to a vacuum switch which comprises a gas-tight sealed evacuated envelope having therein a stationary contact element and a movable contact element which is movable towards and away from the stationary contact element, and in which at least one of the contact elements consists of a disc-shaped contact portion and a bush-shaped portion which is connected to or integral with the disc-shaped portion, a conductor being present within the bush-shaped portion and connected in series with the associated contact element so as to produce an electric field in order to improve the current interruption characteristics of the vacuum switch. A vacuum switch of this kind is described in U.S. Pat. No. 3,082,307.

2. Description of the Prior Art

The known vacuum switch comprises an evacuated, insulating cylindrical envelope which is sealed by metal end plates, and includes a stationary contact element and a contact element movable towards or away from the stationary element within the envelope, at least one of the contact elements being provided with a bush-shaped contact portion connected in a gas-tight manner through the respective metal end plate. This bush-shaped contact portion may contain a conductor connected to the associated contact element, the conductor generating a magnetic flux at the contact area of the cooperating contact elements. This magnetic flux acts to improve the current-interruption characteristics of the vacuum switch.

SUMMARY OF THE INVENTION

It is an object of the present invention to simplify such a known vacuum switch, and in particular to simplify the fabrication of the conductor. According to the present invention, a switch of the general type mentioned above is fabricated with the conductor formed as a spiral conductor. The spiral conductor can be made in a simple manner by means of casting, die-casting, cold or hot pressing, for which a very simple unidirectionally relievable die may be used.

In a preferred embodiment, the outer turn of the spiral conductor is connected to the inner wall of the bush-shaped portion and the inner turn of the spiral conductor is connected to a contact rod extending through the envelope, the contact rod supporting the corresponding contact element.

The spiral conductor may alternatively be integrally formed with the bush-shaped portion. The contact rod may constitute an integral part of the spiral conductor.

For increasing the mechanical strength between the contact element and the spiral conductor it is desirable to make the vacuum switch such that the spaces between the turns of the spiral conductor, between the conductor and the bush-shaped portion and between the conductor and the disc-shaped contact portion are partially or completely filled with a solid insulating material.

DESCRIPTION OF THE DRAWINGS

The invention will now be described, by way of example, with reference to the accompanying drawings, wherein.

DETAILED DESCRIPTION OF THE PREFERRED EMBODIMENTS

Figure 1:
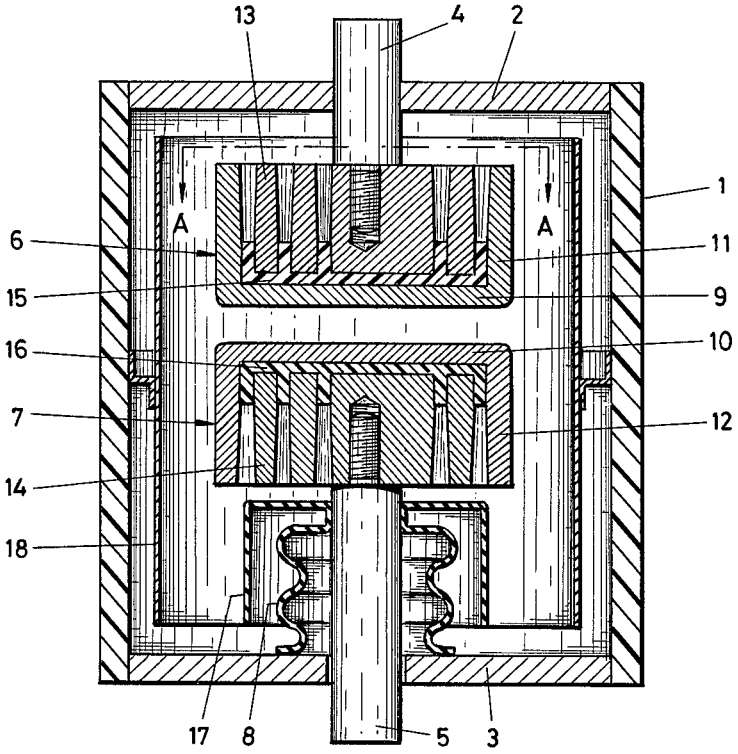
FIG. 1 is a longitudinal section of a vacuum switch in accordance with the present invention.

Referring to FIG. 1, the vacuum switch is provided with a cylindrical insulating part 1 and two metal end plates 2 and 3 closing the ends of the insulating part 1. A contact rod 4 extends through the metal end plate 2 and a stationary first contact element 6 is mounted on the end of the contact rod 4. A contact rod 5 extends through the other metal end plate 3 and a second contact element 7 is mounted on the end of the rod 5. The contact element 7 is a movable contact element, and to that end the seal between the contact rod 5 and the end plate 3 is achieved with the aid of bellows 8. The space which is defined by the cylindrical insulating part 1, the two metal end plates 2 and 3 and the bellows 8 is evacuated.

Each of the two contact elements 6 and 7 consists of a disc-shaped contact portion 9 or 10 and a bush-shaped portion 11 or 12 which is respectively integral with the disc-shaped portion 9 or 10. Two spiral conductors 13 and 14 are respectively mounted within the portions 11 and 12. The outer helical turn of each conductor 13 or 14 is connected to the inner wall of the corresponding bush-shaped portion 11 or 12, and the inner helical turn is joined to the contact rod 4 or 5. This latter joint may consist of a screwed joint, as illustrated in FIG. 1.

As shown in FIG. 1, the spaces between the turns of the spiral conductor 13 or 14, between the conductor 13 or 14 and the bush-shaped portion 11 or 12 as well as the space between the spiral conductor 13 or 14 and the disc-shaped contact portion 9 or 10 are partially filled with solid insulating material 15 or 16. As a result, the mechanical strength between the contact rods 4 and 5 and the respective disc-shaped contact portions 9 and 10 is considerable. The insulating material may consist of a cast resin and may alternatively completely fill the aforementioned spaces.

FIG. 1 illustrates, in addition, co-axial metallic shield members 17, 18 for protecting the flexible bellows 8 and the cylindrical insulating part 1 from arc-striking products generated during the current interruption period.

Figure 2:
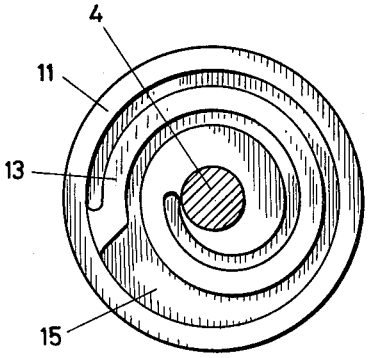
FIG. 2 is a view of one of the contact elements of the vacuum switch taken on the line A—A of FIG. 1.

FIG. 2 is a view of the contact element 6 taken on the line A—A of FIG. 1; in this embodiment the outer end of the spiral conductor 13 has been brazed or soldered to the inner surface of the bush-shaped contact portion 11.

Figure 3:
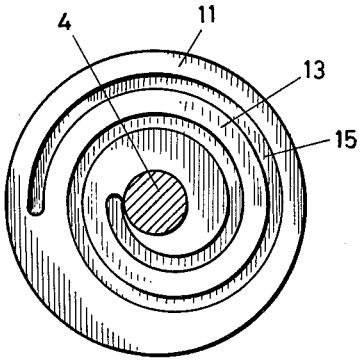
FIG. 3 is a similar view to that of FIG. 2 but illustrating a modified contact element.

In FIG. 3, the spiral conductor 13 forms an integral part of the bush-shaped contact portion 11.

The disc-shaped contact portions 9 and 10 may be joined as individual parts to the respective bush-shaped contact portions 11 and 12, e.g. by brazing or welding. However, the disc-shaped contact portions 9 and 10 are preferably integrally formed with the respective bush-shaped contact portions 11 and 12.

I claim:

1. A vacuum switch comprising means forming a gas-tight sealed evacuated envelope and having therein a stationary contact element and a movable contact element movable towards or away from the stationary contact element, at least one of the contact elements consisting of a disc-shaped contact portion and a bush-shaped portion connected to or integral with the periphery of the disc-shaped portion and extending in a direction away from the associated contact element, a spiral conductor positioned radially within the bush-shaped contact portion and being electrically connected in series with the associated contact element, the spiral conductor producing an electric field in order to improve the current interruption characteristics of the vacuum switch.

2. A vacuum switch according to claim 1, wherein the outer turn of the spiral conductor is connected to the inner wall of the bush-shaped portion and the inner turn of the spiral conductor is connected to a contact rod which extends through the means forming the envelope, the contact rod supporting the corresponding contact element.

3. A vacuum switch according to claim 2, wherein the spiral conductor is integrally formed with the bush-shaped portion.

4. A vacuum switch according to claim 2, wherein the contact rod is integrally formed with the spiral conductor.

5. A vacuum switch according to claim 1, wherein spaces between the turns of the spiral conductor, between the spiral conductor and the bush-shaped portion, and between the spiral conductor and the disc-shaped contact portion are partially filled with solid insulating material.

6. A vacuum switch according to claim 5, wherein said solid insulating material completely fills the spaces between the turns of the spiral conductor, between the spiral conductor and the bush-shaped portion, and between the spiral conductor and the disc-shaped contact portion.

* * * * *

UNITED STATES PATENT OFFICE

CERTIFICATE OF CORRECTION

PATENT NO. : 4,109,123

DATED : August 22, 1978

INVENTOR(S) : Joseph H. F. G. Lipperts

It is certified that error appears in the above-identified patent and that said Letters Patent are hereby corrected as shown below:

[30] FOREIGN APPLICATION PRIORITY DATA

February 3, 1976 The Netherlands.....76.01084

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*